United States Patent [19]

Wiberg

[11] Patent Number: 4,681,474

[45] Date of Patent: Jul. 21, 1987

[54] ARRANGEMENT FOR HOLDING AND FILING DOCUMENTS, PAPERS AND THE LIKE

[75] Inventor: Olle Wiberg, Storvreta, Sweden

[73] Assignee: Esselte Almanacksforlag AB, Solna, Sweden

[21] Appl. No.: 806,271

[22] Filed: Dec. 6, 1985

[30] Foreign Application Priority Data

Dec. 18, 1984 [SE] Sweden ..... 8406435

[51] Int. Cl.[4] ..... B42F 13/00; B42D 3/00

[52] U.S. Cl. ..... 402/75

[58] Field of Search ..... 402/75, 70, 60, 78; 40/359; 281/31; 428/100, 205, 20

[56] References Cited

U.S. PATENT DOCUMENTS

| | | | |
|---|---|---|---|
| 2,888,934 | 6/1959 | Segal | 402/75 |
| 4,444,418 | 4/1984 | Goldstein | 402/75 |
| 4,445,710 | 5/1984 | Borel | 402/75 |

FOREIGN PATENT DOCUMENTS

| | | | |
|---|---|---|---|
| 66498 | 3/1914 | Austria | 402/75 |
| 699977 | 2/1931 | France | 402/75 |
| 43081 | 4/1916 | Sweden | 402/75 |

*Primary Examiner*—Frank T. Yost
*Assistant Examiner*—Paul M. Heyrana
*Attorney, Agent, or Firm*—Silverman, Cass, Singer & Winburn, Ltd.

[57] ABSTRACT

An arrangement for handling documents, papers etc., comprising a so-called ring mechanism (1) for co-operation with hole-punched paper sheets, and a support means such as a folder, calendar (18), binder or file (21; 28) or the like. In accordance with the invention there is attached to the side of the ring mechanism (1) remote from the rings ((3) a first fastener part (8) of a so-called burrfastener arrangement, while a second fastener part (9) of the arrangement is attached to the support means ((15; 21; 28). The fastener parts (8,9) are arranged to co-operate with one another in a manner which enables the ring mechanism (1) to be detachably connected to the support means (15; 21; 28).

11 Claims, 5 Drawing Figures

ARRANGEMENT FOR HOLDING AND FILING DOCUMENTS, PAPERS AND THE LIKE

The present invention relates to an arrangement for holding and filing documents, papers and the like.

In offices and like places, documents, papers etc. are normally filed in so-called ring binders or folders, comprising a number of openable rings which co-operate with holes punched in the documents or papers to be filed.

Recent years have seen the advent of system calendars provided with fixed ring mechanisms. These systems are mainly used to hold sheets of paper by means of which the user may plan his/her activities, make notes etc. The systems are often composed to form small-size conference folders. Such ring-mechanism folders when purchased will normally include a number of pre-printed pages or sheets made of card or paper, which can be used to construct a plan for the coming year's activities, to record schedules, to form registers, and as calendars etc., so as to enable the user to plan his/her time more readily. The folder may also incorporate pockets for holding a diary, a pocket calculator and the like. Such folders are compiled on the basis that they include all that is necessary for the user to plan his/her activities.

It is often necessary, however, when visiting clients or customers, when travelling, or when attending conferences, committee meetings or like appointed meetings to have immediately available documents and papers which concern the person to be seen or the specific meeting to be attended. Such papers and documents are normally held in other, separate files, binders etc., from which they must be extracted in order to be available for the particular visit or meeting in question.

The present invention relates to an arrangement which provides a much more effective system for filing and handling documents and like papers.

Accordingly, the present invention relates to an arrangement for handling and filing documents, papers and like sheets, comprising a so-called ring mechanism for cooperation with hole-punched paper sheets, and a documentsupport means in the form of a folder, calendar, binder or the like, and is characterized in that attached to the side of the ring mechanism remote from the rings is a first part of a so-called burr or velcro fastener arrangement; and in that a second part of the fastener arrangement is attached to the document support means, said fastener parts being arranged to co-act with one another in a manner which enables the ring mechanism to be detached from the documentsupport means.

The invention will now be described in more detail with reference to embodiments thereof illustrated in the accompanying drawings, in which FIG. 1 is a perspective view of a ring mechanism in which the invention is applied;

Figure 1:
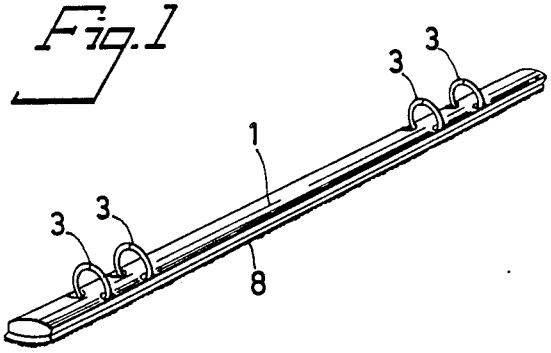

Illustrated in the respective figures of the drawings is an arrangement for facilitating the filing, holding and general handling of documents, papers etc. The arrangement comprises a so-called ring mechanism 1, which is intended to co-operate with hole-punched paper sheets 2, in the manner illustrated in FIG. 1. The ring mechanism 1 is of a known kind and incorporates a plurality of split rings 3, which can be opened in a known manner, by simply pulling them apart. Alternatively, the ring mechanism may be provided at each end 6,7 thereof with a press-button, which when pressed causes the rings to open. Since the ring mechanism is known to the art, it will not be described in further detail.

In accordance with the invention there is attached to the side of the ring mechanism 1 remote from the rings 3 a first part 8 of a so-called velcro-fastener or burr-fastener arrangement. A second part 9 of the burr-fastener arrangement is attached to a support means 10. In the widest aspect of the invention, the support means 10 may comprise a binder, a folder or the like, depending on how the documents or papers are to be filed and stored. The aforesaid fastener parts 8,9 are intended to co-act with one another in a manner which enables the ring mechanism 1 to be attached to and detached from the support means 10.

By "burr-fastener" is meant the known and commercially available types of fasteners comprising a so-called male part comprising a large number of outwardly projecting small, hook-like filaments 11 made of a relatively hard plastics material, and a so-called female part comprising a felt-like part 12 having a large number of softer, crimped plastics fibres. When the male part of the fastener is brought into abutment with the female part thereof, in the direction of the arrows 13, and a slight pressure is exerted, the hook-like plastics filaments 11 penetrate the felt-like part 12 and fasten therein. This provides a relatively strong connection. This connection, however, is not so strong as to prevent the male part being removed from the female part when lifted at one end therefrom, as indicated by the arrow 14, therewith enabling the male part to be progressively lifted from the female part.

When the fastener parts 8,9 are pressed together, a burr-type fastener of this kind will afford a sufficiently strong connection for the purpose in question.

According to a preferred embodiment of the invention the aforesaid first fastener part 8 is a male fastener-part and the aforesaid second fastener part 9 is a female fastener-part. The first and the second fastener parts 8 and 9 are preferably in the form of strips. The strip-like fastener parts are preferably provided with a self-adhesive layer, by means of which the fastener parts can be attached to the ring mechanism 1 and the support means 10 respectively.

The present invention enables a ring mechanism in which various papers or documents are filed, such as documents or papers relating to a given group of products, a certain client, a certain investigation, a given register etc., can be detachably fastened to a support means 10, as a storage article which can be kept in a special place. When requiring specific documents or papers filed in the storage article, for example in connection with a conference or a journey, these papers can be readily extracted from the storage article and placed in another holder, such as a conference folder for example.

Figure 3:
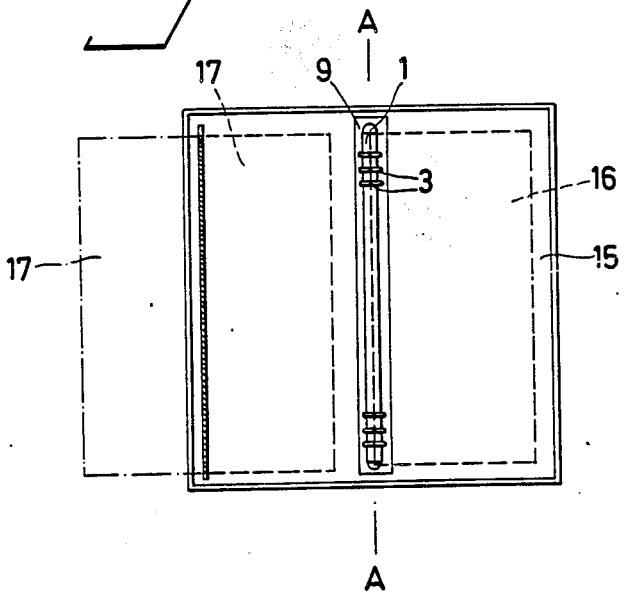
FIG. 3 illustrates schematically a system calendar in which the invention is applied.

According to a particularly preferred embodiment of the invention, the aforementioned support means comprises a so-called system calendar 15, a conference folder or the like, to which the second fastener part is attached along a folding line A-A 16 on the support means. Thus, according to this embodiment a ring mechanism 1 having inserted therein a plurality of sheets 16 containing factual information, customer information, budget information etc. and kept in a ring mechanism in a storage article can be extracted therefrom and inserted in the system calendar 15 at the location of the ring mechanism of said calendar in which sheets relating, for example, to a specific client to be visited are found inserted. When another client is to be visited, the just mentioned ring mechanism is removed and replaced with another ring mechanism containing papers or documents relating to this further client or customer. Such a system calendar suitably includes a diary 17, illustrated in broken lines to the left of FIG. 3, thereby ensuring that the user has constant access to his/her time schedule, irrespective of to which client the sheets 16 in the ring mechanism 1 relate.

It will readily be seen that the present invention enables documents, papers etc. to be handled in a particularly flexible and advantageous manner when compared with those systems hitherto available. In brief, it can be mentioned that hitherto there have been two principal possibilities of taking documents on a journey or to a meeting or conference for example. The one possibility is to remove the documents required from a number of separate conventional files or binders, and to carry these documents loosely in a plastic wallet or the like. This possibility involves time in sorting out the documents required and also in replacing the documents in their correct order and position. The other possibility is one of taking a number of files or binders to the meeting in question or on the aforesaid journey, despite needing only some of the documents or papers contained in the files.

Figure 4:
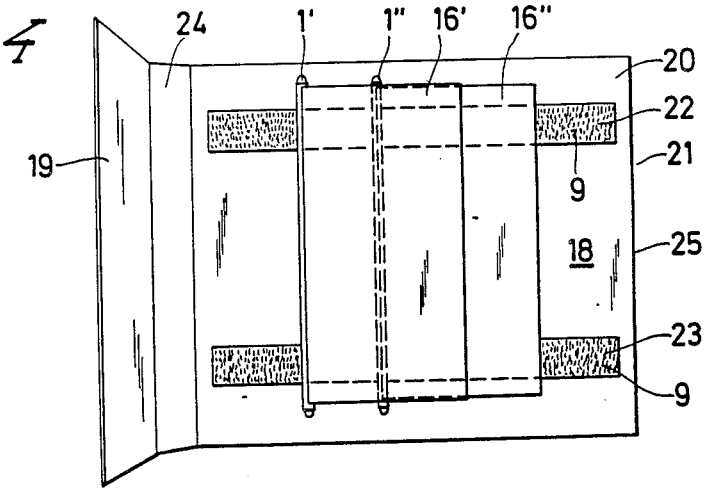
FIG. 4 illustrates schematically a folder or binder in which the invention is applied.

According to one preferred embodiment of the invention the support means comprises the inner face 18 of one side 19, 20 of a storage file or binder 21, as illustrated in FIG. 4. In this embodiment, the second fastener part 9 preferably comprises two or more mutually parallel strips 22,23 extending from the spine 24 of the binder 21 out towards the edge 25 of the binder side 20 parallel with the spine 24.

Figure 2:
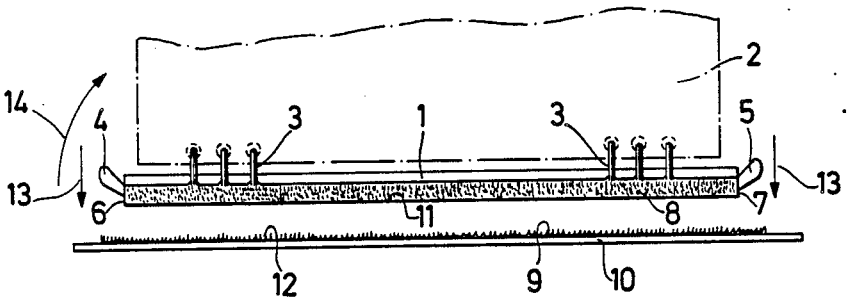
FIG. 2 is a side view of a ring mechanism and a support means.

The sheets 16 capable of being inserted in a system calendar 15 are suitably much smaller than a regular A-4 size. By making the storage binder 21 larger than the size of the sheets 16, it is possible to store a plurality of ring mechanisms 1', 1'' with associated sheets 16', 16'' in one storage binder 21. For example, each of the ring mechanisms 1', 1'' may contain sheets relating to a specific client. Although FIG. 2 shows only two such units, it will be understood that several more units can be inserted in the binder, as illustrated by the figure.

It will be readily be seen that this embodiment in combination with the aforedescribed embodiment relating to a system calendar 15 will afford the aforedescribed flexible handling of documents.

Figure 5:
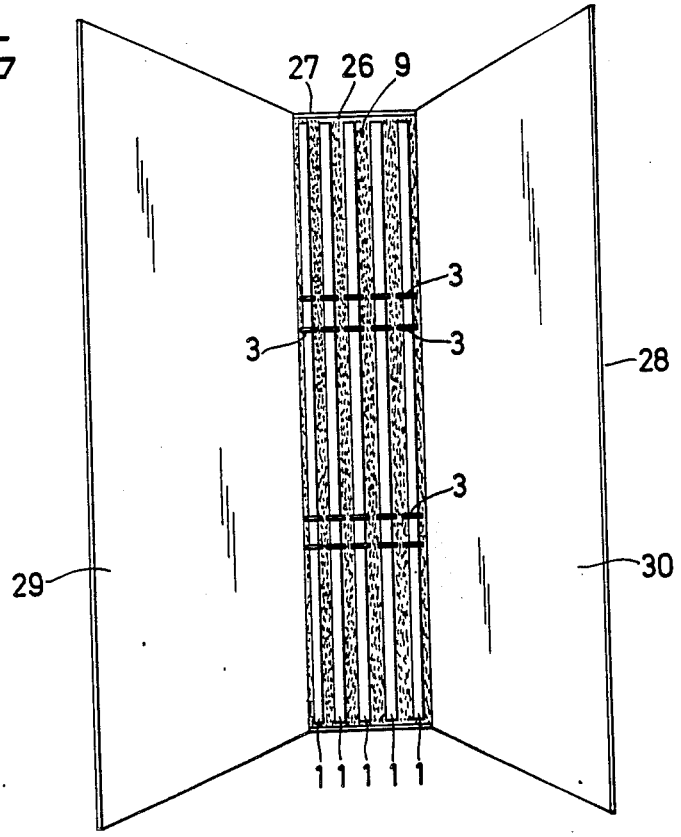
FIG. 5 illustrates schematically a further folder or binder embodiment in which the invention is applied.

In accordance with a further embodiment of the invention, the support means comprises the inside 26 of the spine 27 of a storage binder 28, or a corresponding article for storing and safekeeping of documents or papers, as illustrated in FIG. 5, in which the sides of the binder are referenced 29,30. In this embodiment, preferably the inner surface 26 of the whole of the spine 27 is covered with the aforesaid second part 9 of the burr-fastener arrangement.

For the sake of illustration, no sheets or documents are shown inserted in the binder, which is shown to incorporate five ring mechanisms 1 by way of example. A binder 28 of this kind affords considerable advantages over conventional binders or files containing solely one non-detachable ring mechanism. Thus, a conventional binder having a contents register or guide cards inserted therein, with a group of documents sorted and filed under respective cards can be replaced with a binder in which each group of documents are held by a respective ring mechanism 1, which can be detachably connected to the aforesaid second fastener part 9, i.e. to the inside of the binder spine, by means of the present invention.

When a group of documents is required, it is only necessary to remove the ring mechanism containing said documents. When these documents are to be taken to a conference or to a meeting, or carried on a journey, the ring mechanism can be attached, for example, to a conference-type folder incorporating the aforesaid second fastener part 9.

The use of the aforesaid burr-fastener arrangement affords another important advantage over other fastener arrangements. The most important advantage, decisive in respect of many applications, is that the first fastener part 8 need not be adapted to the second fastener part 9 with respect, inter alia, to dimensions, manufacturing material etc. It is namely so that a first fastener part 8 will adhere to felt-like parts 12 of different design and fabrication. This enables a ring mechanism to be interchanged between mutually different system calendars, folders, storage binders, files etc., without requiring the two fastener parts 8,9 to match one another to any precise extent.

Another important advantage is that the aforesaid fastener parts 8,9 may, and do, comprise a soft material suitable for use in conjunction with the aforesaid calendars and folders. For example, this enables a system calendar to be used solely as a calendar and/or as a wallet in the absence of a ring mechanism 1 therein. A system calendar 15 of the aforesaid kind may also incorporate pockets for banknotes, credit cards etc.

The invention can be applied in many different ways, of which only a few have been mentioned here. It will be obvious to everyone, however, that the invention is not restricted to the aforedescribed embodiments.

The invention is not restricted to the aforedescribed embodiments and can be modified within the scope of the following claims.

I claim:

1. A system calendar folder for use with a plurality of ring mechanisms, each ring mechanism accommodating a plurality of sheets of paper having dimensions substantially smaller than conventional A4 sized sheets, said folder comprising:

a folder having front and back side piece cover portions joined together at a common inner edge and open at respective outer edges thereof;

said folder having sheet retaining means attached to the inside of said folder adjacent said common inner edge;

the improvement wherein said sheet retaining means includes means for detachably supporting one of a plurality of ring mechanisms having rings on one side for co-action with hole-punched paper sheets, said supporting means including a hook and loop fastener having a first part and a second part, said first part being attached to said ring mechanism on the side thereof opposite said rings, and said second part of said hook and loop fastener being attached directly to said folder along said common edge, said fastener parts being arranged to cooperate with one another to detachably connect each ring mechanism to said supporting means to solely support said ring mechanism in said folder.

2. The calendar according to claim 1, wherein said first fastener part is a male part of said fastener arrangement, and said second fastener part is a female part of said arrangement.

3. The calendar according to claim 1, wherein said first fastener part and said second fastener part are formed as strips.

4. A storage binder system for use with a plurality of ring mechanisms, each mechanism accommodating a plurality of sheets of paper, said system comprising:

a storage binder having front and back side piece cover portion joined together at a common inner edge and said storage binder being open at respective outer edges thereof;

said storage binder having means for detachably supporting a plurality of ring mechanisms having rings on one side for co-action with hole-punched paper sheets, said supporting means including a hook and loop fastener having a first part and a second part, said first part being attached to said ring mechanism on the side thereof opposite said rings, and said second part of said hook and loop fastener being attached directly to said storage binder, said fastener parts being arranged to cooperate with one another to detachably connect each ring mechanism to said supporting means to support said ring mechanisms in said storage binder.

5. The system according to claim 4 wherein said storage binder includes a spine portion attached between said front and back side piece cover portions along said common edge and said second fastener part includes at least two substantially parallel strips extending substantially perpendicular to said common edge along one of said front and back side piece cover portions toward an open edge thereof for fastening said ring mechanisms.

6. The system according to claim 4 wherein said storage binder includes a spine portion attached between said front and back side piece cover portion along said common edge and said second fastener part includes a strip substantially covering said spine portion for fastening said ring mechanisms.

7. A document handling system including a system calendar folder for use with a plurality of ring mechanisms, each ring mechanism accommodating a plurality of sheets of paper and a storage binder system for retaining a plurality of the ring mechanisms, said document handling system comprising:

said system calendar folder including a folder having front and back side piece cover portions joined together at a common inner edge and open at respective outer edges thereof;

said folder having sheet retaining means attached to the inside of said folder adjacent said common inner edge;

said sheet retaining means including means for detachably supporting one of a plurality of ring mechanisms having rings on one side for co-action with hole-punched paper sheets, said supporting means including a hook and loop fastener having a first part and a second part, said first part being attached to said ring mechanism on the side thereof opposite said rings, and said second part of said hook and loop fastener being attached directly to said folder along said common edge, said first and second fastener parts being arranged to cooperate with one another to detachably connect each ring mechanism to said supporting means to solely support said ring mechanism in said folder;

said storage binder system including a storage binder having front and back side piece cover portions joined together at a common inner edge;

said storage binder having means for detachably supporting a plurality of said ring mechanisms having rings on one side for co-action with hole-punched paper sheets, said supporting means including a third hook and loop fastener part, said third part of said hook and loop fastener being attached directly to said storage binder, said first and third fastener parts being arranged to cooperate with one another to detachably connect each ring mechanism to said supporting means to support said ring mechanisms in said storage binder.

8. The document handling system according to claim 7, wherein said first fastener part is a male part of said fastener arrangement, and said second and third fastener parts are a female part of said arrangement.

9. The document handling system according to claim 7. wherein said first, second and third fastener parts are formed as strips.

10. The document handling system according to claim 7 wherein said storage binder includes a spine portion attached between said front and back side piece cover portions along said common edge and said second fastener part includes at least two substantially parallel strips extending substantially perpendicular to said common edge along one of said front and back side piece cover portions toward an open edge thereof for fastening said ring mechanisms.

11. The document handling system according to claim 7 wherein said storage binder includes a spine portion attached between said front and back side piece cover portion along said common edge and said second fastener part includes a strip substantially covering said spine portion for fastening said ring mechanisms.

* * * * *